US011871831B2

(12) United States Patent
McMullen et al.

(10) Patent No.: US 11,871,831 B2
(45) Date of Patent: Jan. 16, 2024

(54) ELECTRICAL AUTOMATED NAIL-CLIPPING DEVICE

(71) Applicants: Thomas J. McMullen, Dellwood, MN (US); Larry J. Gau, Dayton, MN (US); Steven N. Kisch, Zimmerman, MN (US)

(72) Inventors: Thomas J. McMullen, Dellwood, MN (US); Larry J. Gau, Dayton, MN (US); Steven N. Kisch, Zimmerman, MN (US)

( * ) Notice: Subject to any disclaimer, the term of this patent is extended or adjusted under 35 U.S.C. 154(b) by 824 days.

(21) Appl. No.: 16/900,918

(22) Filed: Jun. 13, 2020

(65) Prior Publication Data

US 2021/0059379 A1 Mar. 4, 2021

Related U.S. Application Data

(63) Continuation-in-part of application No. 15/715,886, filed on Sep. 26, 2017, now Pat. No. 10,779,628.

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
CPC . A45D 29/023; A45D 29/02; A45D 2029/026
See application file for complete search history.

(56) References Cited

U.S. PATENT DOCUMENTS

| | | | | |
|---|---|---|---|---|
| 2,955,354 | A | 10/1960 | Laing | |
| 3,838,507 | A | 10/1974 | Clark | |
| 3,845,553 | A | 11/1974 | Fields | |
| 4,228,585 | A | 10/1980 | Nelson | |
| 5,123,430 | A | 6/1992 | Davidovitz | |
| 5,557,849 | A * | 9/1996 | Lee | A45D 29/02 30/29 |
| 5,622,191 | A | 4/1997 | McMullen | |
| 5,653,024 | A * | 8/1997 | Cartagenova | A45D 29/023 30/28 |
| 5,791,049 | A * | 8/1998 | Dolev | A45D 29/02 30/28 |
| 6,865,312 | B2 | 3/2005 | Martin | |
| 7,000,321 | B1 | 2/2006 | Rodgers | |

(Continued)

FOREIGN PATENT DOCUMENTS

| | | |
|---|---|---|
| JP | 58-166705 | 11/1983 |
| JP | 4-125809 | 11/1992 |

(Continued)

*Primary Examiner* — Rachel R Steitz
*Assistant Examiner* — Brianne E Kalach
(74) *Attorney, Agent, or Firm* — MARK A. LITMAN & ASSOCIATES, P.A.

(57) ABSTRACT

An automatic nail clipping device including a blade plate replaceably secured within a blade plate holder frame within a covering shell, an electronic motor driving a shaft which in turn rotates an extending cam element. The extending cam element engaging an oblong opening on a backside of the blade plate holder frame, raising and dropping the entire blade plate holder frame, and causing the blade in the blade plate to clip nails in a downward movement and return the blade plate to a ready elevated position.

19 Claims, 15 Drawing Sheets

(56) References Cited

U.S. PATENT DOCUMENTS

| | | | | |
|---|---|---|---|---|
| 7,003,882 | B2 * | 2/2006 | Sakai | A45D 29/02 30/28 |
| 7,954,242 | B1 * | 6/2011 | Brizan | A45D 29/02 30/28 |
| 2006/0042559 | A1 | 3/2006 | Kang | |
| 2009/0119922 | A1 | 5/2009 | Doyle | |
| 2010/0107989 | A1 * | 5/2010 | Manheimer, III | A01K 17/00 119/600 |
| 2012/0204891 | A1 * | 8/2012 | McCourtney | A45D 29/22 30/28 |

FOREIGN PATENT DOCUMENTS

| | | | |
|---|---|---|---|
| KR | 2005-0093001 | A | 9/2005 |
| KR | 2009-0048660 | | 5/2009 |

* cited by examiner

FIG. 6
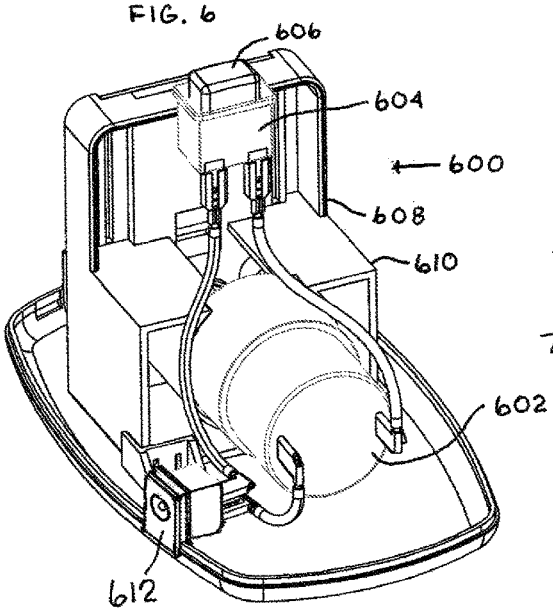
FIG. 7
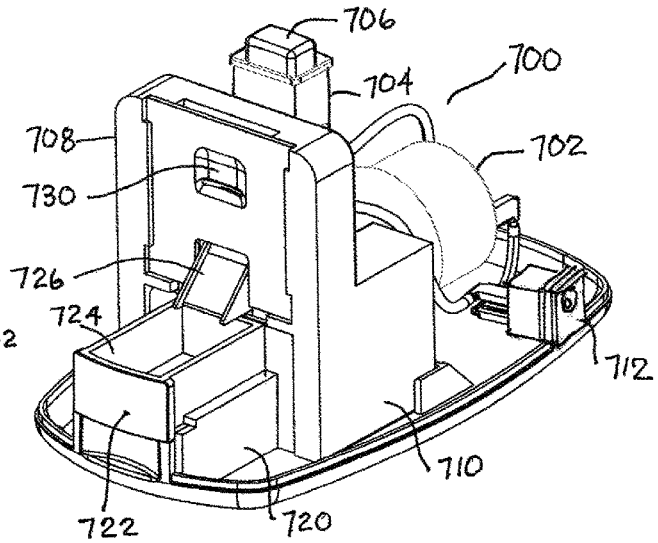
FIG. 9A
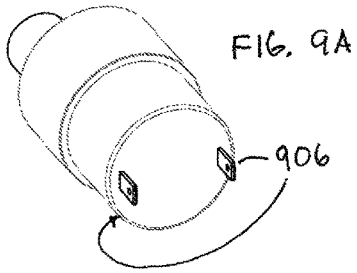
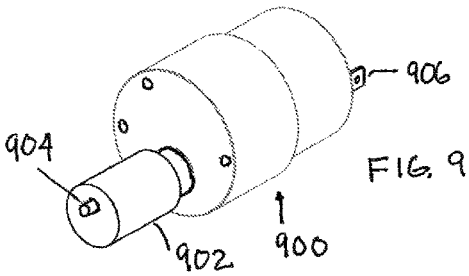
FIG. 9B

ELECTRICAL AUTOMATED NAIL-CLIPPING DEVICE

RELATED APPLICATION DATA

The present application claims priority under 35 U.S.C. 120 as a Continuation-in-Part of copending U.S. patent application Ser. No. 15/715,886, filed 26 Sep. 2018 and Titled "ELECTRONIC NAIL CLIPPER."

BACKGROUND OF THE INVENTION

1. Field of the Invention

The present invention relates to the field of toe nail clippers and especially automated toe nail clippers for use with human hands and feet for clipping fingernails and toenails.

2. Background of the Art

One of the more obvious needs for personal grooming is the need to clip fingernails as they are unsightly when not properly addressed. Where open-toe shoes are used or individuals are barefoot, toenails are similarly important for grooming. Many groups of individuals are unable to groom their own nails because of infirmity, disability and the like, such as having only a single arm, back problems limiting bending, muscle weakness, partial paralysis, tremors, poor vision and the like. Nail trimming therefore becomes difficult and often requires individuals to seek the aid of others to enable them to maintain their desired level of personal grooming. This increases their dependency on others and adds to feelings of guilt in those requiring such basic care from third parties.

U.S. Pat. No. 7,954,2423 (Brizan) discloses a manual or electric nail clipper that can assist individuals to either manually or automatically clip a toenail or fingernail. The fingernail or toenail is inserted into the front end of the device and a pair of trimming edges move together to clip the fingernail or toenail safely, easily and conveniently. One of the embodiments contemplates a manual device and the other is an electric device.

U.S. Pat. No. 6,865,312 discloses a nail trimmer for enabling a person to comfortably trim toenails without having to take on an awkward or uncomfortable posture. The nail trimmer has a long extension housing, which has a handle at its upper end and a trimmer unit at its lower end. A battery-operated motor and on/off switch are incorporated into the handle end. A detachable trimmer unit is connected at the lower end. A dado cutting blade and a gear unit are enclosed in the trimmer unit. An opening in the trimmer unit housing provides access to the cutting edge of the blade.

U.S. Pat. No. 5,123,430 (Davidovitz) discloses a cutter device particularly useful for cutting fingernails and toenails includes a housing grippable by a user for holding and manipulating the device. A slot is formed in a conical end portion of the housing and is elongated in the circumferential direction for receiving a nail to be cut. A rotatable head having an outer conical surface is rotatably mounted within the conical end portion of the housing. A blade is fixed to the rotatable head and has a cutting edge extending substantially radially of the conical surface of the head and perpendicularly to the slot. A motor within the housing and coupled to the head rotates the head, and the blade fixed thereto, such that the cutting edge of the blade is rotated substantially perpendicularly to the direction of elongation of the slot and the nail received therein.

Various animal nail clippers have been shown in the prior art such as U.S. Pat. No. 2,955,354, issued to Laing, and U.S. Pat. No. 3,838,507 issued to Clark, and U.S. Pat. No. 4,228,585, issued to Nelson. One of the deficiencies in prior art clippers is no provision for localizing the quick of the nail prior to clipping the nail thus avoiding the aforementioned injury. The present invention overcomes this deficiency by providing a mechanically actuated nail clipper for an animal, or pet, which allows the user to sense the position of the quick prior to clipping the nail then to clip the nail safely at the desired length.

Further, the U.S. Pat. No. 3,845,553 to Fields showed a claw clipper with a reciprocating cutter. The clipper has a gauge 56 to establish how much nail to remove. The reciprocating cutter, 30, then is rapidly advance to clip the nail using a motorized screw. The cutter includes a spring to return the cutter to a recoiled position for the motorized screw to advance the cutter again, reciprocally. Alas, this patent does not detect the presence of the quick with any sensor.

The published patent application to Kang, No. 2006/0042559 shows a clipper for pet claws with a lever operated cutter. The clipper receives a nail on the side and the nail proceeds between the two blades of the cutter. The cutter has a fixed blade and a rotating blade. Grasping the lever rotates the rotating blade to clip the nail. The application discloses a battery powered motor in the larger handle for grinding a clipped nail. The present invention though has a cutter that receives a nail from the bottom and a cutter with two blades. The blades of the present invention slide along a common line while abutting each other. The present invention lacks a motor or other grinding feature but does have the sensing means and quick indicator which differentiates the present invention from the Kang publication.

U.S. Pat. No. 7,000,321 (Rodgers) discloses an optical source and corresponding sensor for detecting the quick of an animal's nail. This patented device has a mechanical clipper with a sliding blade coupled with an optical source and sensor. The source and sensor are mounted proximate the clipper so an accurate reading of light passing through a nail is ascertained by the sensor prior to usage of the clipper. The present invention though has sensing through electrical charge or capacitance or resistance, a thermocouple, piezoelectric, heat, ultrasound, x-ray radiation, and infrared radiation. Once the quick is detected using the sensor, the present invention activates a quick indicator, preferably LED of single or multiple colors, to avoid startling an animal, to guide the user in operating the present invention.

U.S. patent application (Huggans) published as No. 2005/0132975, shows a hand powered nail and claw clipper. The clipper has a mechanical two blade guillotine type cutter where one blade is advanced along the other blade when the handle is closed. The clipper also has a sensor located in the fixed blade opposite the advancing other blade. The sensor is preferably a high intensity light with a cooperating detector or alternatively an ultrasound detector, a pulse oximeter, a laser, and an infrared thermometer. The present invention shares some features with this allowed application. However, the present invention has at least one LED to inform the operator visually, using single or multiple colors, about proximity to the quick and a detector capable of initializing itself. The detector establishes, or uses a pre-established, baseline on a non-quick substance, such as air, and uses that baseline to later determine the location of the cutting blade relative to the quick. An operator need not look at the position of the cutting blade on a nail but rather at the LED.

U.S. Pat. No. 8,100,088 (Manheimer) discloses a clipper for clipping nails of an animal such as a dog, or cat, that allows for the clipping of an individual nail at the desired length while preventing injury to the animal, including a clipper portion and a sensing portion which allows the nail to be localized in a desired position relative to the clipping plane of the clipper and the internal structure of the nail, wherein the sensing portion is included within circuitry that includes a signal generation portion, a signal reception portion, and a quick indicator. The animal nail is positioned near the clipper portion and the sensing portion produces a sensible signal confirming the position of the clipping plane upon the nail, particularly the quick of the nail. The user then may adjust the position of the clipper portion such that the clipping plane avoids the quick. The user then actuates the clipper portion and trims the nail. (1. A device for safely cutting a nail of an animal to a desired length, while reducing the possibility of injury to said animal by cutting into a quick of the nail, comprising: at least one cutting blade; a means for mounting said cutting blade, said mounting means having an accommodation for a sensing means; mechanical actuating means for reciprocally moving said cutting blade from a first position to a second cutting position; a fixed blade having an aperture for receiving the nail of the animal, said fixed blade being placed adjacent said cutting blade; said mounting means having a hollow handle, said handle accommodating said cutting blade, said fixed blade and said actuating means; said actuating means linking to said cutting blade, and having a moveable handle pivotally connecting with said hollow handle thus allowing a user to close said moveable handle upon said hollow handle thus advancing said cutting blade upon said fixed blade to cut a nail of an animal placed within said aperture; a sensing portion capable of detecting the internal structure of the nail of the animal received in said aperture of said fixed blade and providing an indication thereof before actuation of said cutting blade, said sensing portion including said sensing means, an electrical supply located within said hollow handle, a digital processor, and a quick indicator connected together in circuitry; said sensing means arranged adjacent to and connecting with the fixed blade and comprising a capacitor, said capacitor having at least a single plate, said capacitor of the sensing means being arranged at the approximate front end of the sensing means and just adjacent to the edge of the aperture of the fixed blade, said electrical supply providing power to said plate, said capacitor being in communication through said circuitry with said quick indicator, said capacitor including a circuit portion of said circuitry such that changes in the instantaneous capacitance of the capacitor causes a change in the oscillatory frequency of said circuit portion, said oscillatory frequency being interpreted by said digital processor, the digital processor being programmed to differentiate between frequency arising from the interposing of air, nail, or nail with underlying quick as located near the fixed blade aperture during usage; and said quick indicator comprising a visual display communicating with the circuitry for warning a user of said device to the presence of quick of the nail of an animal therein during usage, said visual display being at least one light emitting diode, for warning the user of said device to the presence of quick of the nail of the animal before any cutting occurs.)

U.S. Pat. No. 8,496,013 (McCourtney) discloses a fingernail clipper holding device includes a housing having a hollow interior and having a generally ellipsoid ergonomic configuration that is easy to grip. An upper portion of the housing may include a channel having a configuration to receive the housing of a fingernail clipping device and to hold it securely. The housing defines a receiving area on which a user may position his finger adjacent the cutting head of the fingernail clipping device. A gripping member is attached to a lower portion of the housing to receive a user's fingers or hand. Stabilizing members may be attached to the bottom surface of the lower portion to hold the housing stationary on a flat surface.

Other general disclosures of nail clipping systems include U.S. Pat. Nos. 6,539,632; 5,775,340; and 5,775,340 (with receptacle for cut nails). All documents cited herein are incorporated by reference in their entirety.

The prior art devices are often lacking in ease of use, require manual input, and do not consistently provide safety features to avoid injury to the users.

SUMMARY OF THE INVENTION

An electrically-powered nail cutting apparatus includes a housing having a front face and a rear face, two sides, a top and a bottom. The sides may b more or less relatively distinct because of their geometric shape, such as round, ocal, jagged etc. The front face of the housing having an opening revealing the front access plate with a slot at least 0.5 mm in height and between 0.7 cm and 4 cm in width, the slot having a front-facing opening and a rear-facing opening. Within the housing and proximal to the rear-facing opening is a vertically translating nail-cutting blade plate associated with an electric motor that is configured to translate the nail-cutting blade plate within a blade plate holder frame consecutively down and up. The blade plate is a solid material having a blade and blade support notches on either side to transfer the down and up cutting action. With an opening therein, the top of the opening comprises a cutting blade with a cutting edge within the opening such that the cutting edge is adjacent the rear-facing element.

BRIEF DESCRIPTION OF THE FIGURES

FIG. 6 is a back-rear-to-front perspective view of an opened electrically-powered nail cutting apparatus according to the present invention.

FIG. 7 is a front-to-rear back perspective view of an opened electrically-powered nail cutting apparatus according to the present invention.

FIG. 9A is a rear-to-front perspective view of electrical motor used to assist in motivating cutting blade movement.

FIG. 9B is a back-to-front perspective view of electrical motor used to assist in motivating cutting blade movement.

DETAILED DESCRIPTION OF THE INVENTION

Figure 1:
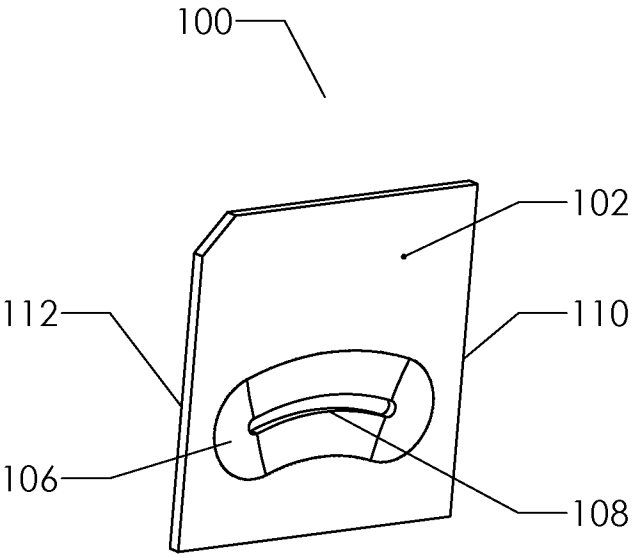
FIG. 1 is a perspective view of a front access plate on an electrically-powered nail cutting apparatus according to the present invention.

An electrically-powered nail cutting apparatus includes a housing having a front face and a rear face, two sides, a top and a bottom. The front face of the housing having an opening revealing the front access plate with an open slot at least 0.5 mm in height and preferably between 0.7 cm and 4 cm in width, the slot having a front-facing opening and a rear-facing opening. Within the housing and proximal to the rear-facing opening is a vertically translating nail-cutting blade plate associated with an electric motor that is configured to translate the nail-cutting blade plate consecutively down and up. The blade plate is a solid material having blade and blade support notches or openings on either side to transfer the down and up cutting action. The dimensions in height facilitate nail thickness entry into the cutting position. Some nails are more curved that others and thicker than others, so that these dimensions may significantly vary upwards, but will not vary to lesser heights as it would severely limit the number of people that could use the clipper. Upper heights can be 0.75 mm, 1.0 mm, 1.25 mm, 1.5 mm and even as much as 3.5 mm to allow toe nails that have been damaged and malformed to fit within the opening and be exposed to the blades. The opening may be relatively uniform in thickness, or have a greater height on one side (or in the middle) than on the other side (or sides) to allow easier unassisted entry into the opening at one position and then repositioning of the nail within the opening to align the entire nail within the opening. The height and shape of the opening could also be controlled by a portion of the covering shell forming the top of the slot. The blade used is preferably made of metal or ceramic, a rust-resistant metal such as stainless steel or titanium, and other components may be variously made of polymeric materials and metal (the motor must have some metal components).

The front-facing opening in the slot further preferably may include a recess for accepting tips of digits or toes when fingernails or toenails, respectively, are inserted into the slot, but without allowing any significant penetration of the flesh of the digit or toe into the opening where the blade could contact the flesh in a cutting orientation. This may be a three-dimensional depression, a cavity, a molded open area, or cutout volume in the front face of the housing. This function may also be controlled by variation of the stock blade plate material.

The apparatus preferably has the electric motor configured to continually move the blade plate up and down, or the electric motor is configured to move the blade plate up and down, with a time delay in transition from at least one direction to the other. A timing element, rheostat or any other timing device may be used to allow time between downward movements of the blade plate for the user to exchange or reorient toes or fingers that are to have their nails trimmed without having to gauge when it is timely to insert a nail in the slot. An indicator light may also be present on the apparatus indicating an appropriate time period when a nail may be inserted as opposed to the user guessing when the slot may not be blocked by the blade plate in an extended, lowered position.

The apparatus may perform its up-and-sown movement of the blade plate by the electric motor engaging the blade plate holder frame with a rotating cam that engages the blade plate holder frame to repetitively move the blade plate up and down. The cam may have a post or pin which rotates inside the oblong, oval cam-receiving opening impacts against the bottom of the blade plate or engages a slot in the blade plate (preferably relatively below the opening to the blade, so that the blade plate is pulled down and pushed up by the rotating movement of the post extending from the cam, driven by the motor).

The apparatus preferably has the blade plate supported within a groove or recess located behind the front face of the housing, with the cutting edge proximal to the slot. The cutting edge of the blade plate should intimately slide across the slot during its repetitive movement. In the apparatus, a guide support feature bracing plate may be located against a side of the blade plate distal from the cutting edge. The guide support feature bracing plate stabilizes the blade plate as the blade plate moves up and down. The bracing plate can be inserted or removed from the apparatus by sliding the brace plate within a second groove that secures the blade plate within the apparatus. Upon removal of the housing and front access plate bracing plate from the apparatus, the blade plate becomes exposed and can be removed from the apparatus. The blade plate is free sliding, and can be slid upward out of the apparatus (e.g., for replacement or sharpening) or it may be manually or tool-removed from the groove.

The apparatus may be configured wherein the bracing plate blade plate holder frame has raised or extending elements on a surface to transmit pressure against the blade plate. As the bracing plate blade plate holder frame is fixed within the apparatus, these elements press against the blade plate to assure a strong pressure of the blade against the slot.

A review of the figures will assist in an understanding of the present invention. FIG. 1 is a perspective view of a front access plate 100 on an electrically-powered nail cutting apparatus according to the present invention. The front access plate 100 has a forward-facing surface 102, a right side 110, a left side 112, an opening 104 for insertion of a removable clippings collection tray (not shown), a recessed area 106 (Only in child and infant versions not adult) for positioning nails into a blade accessing nail receiving slot 108. The front access plate 100 may be permanently affixed onto an electrically-powered nail cutting apparatus according to the present invention, or may be slideable into place on the front of the electrically-powered nail cutting apparatus.

Figure 2:
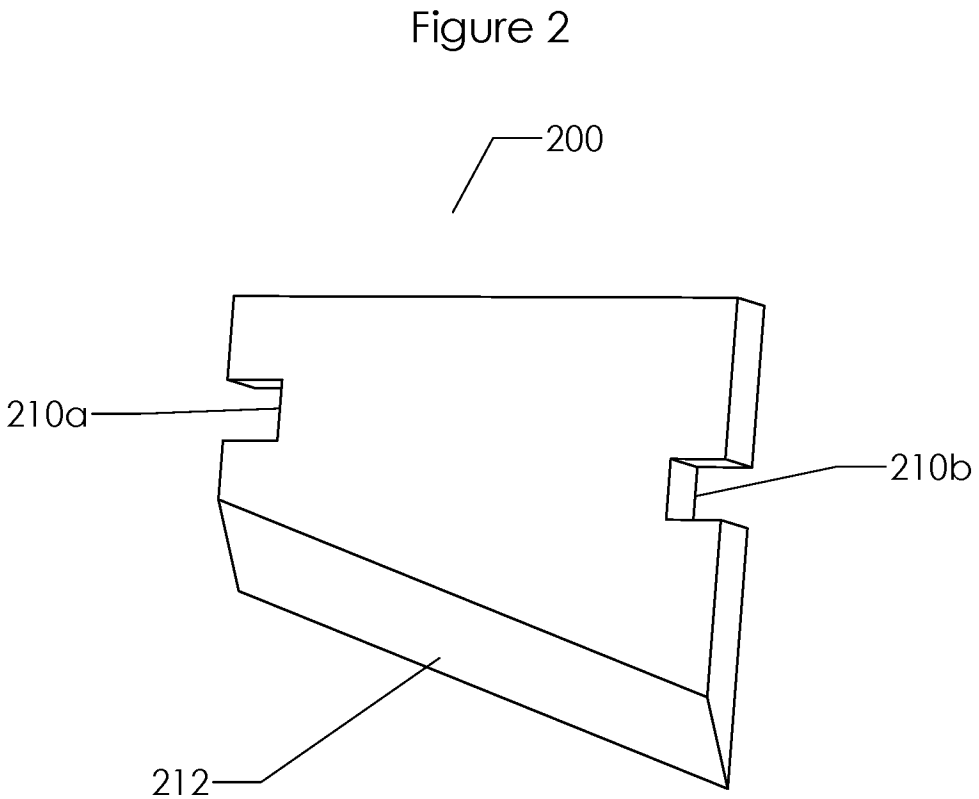
FIG. 2 is a perspective view of a reciprocating cutting blade in an electrically-powered nail cutting apparatus according to the present invention.

FIG. 2 is a perspective view of a reciprocating cutting blade unit (or blade plate) 200 in an electrically-powered nail cutting apparatus according to the present invention. The blade plate unit 200 has a blade 212 and blade plate support notches 210*a*, 210*b*. has a structural frame 202, a blade providing opening 210, a cam attending opening 204 to assist in movement of the blade unit 200, a bottom surface 205 of the blade unit 200, and a blade 212 which is moved repeatedly up and down to slice nails inserted into the electrically-powered nail cutting apparatus according to the present invention. The blade (or blade plate, alternatively) 212 is shown here in a distal portion of the blade unit 200, but may be on a more proximal position in the blade unit 200. That is, the cutting edge of the blade 212 may be farther from or closer to surface 214 of the blade unit 200. As later explained, a rotating element with an eccentrically positioned cam post has the post positioned within the cam attending opening 204. As the cam post is eccentrically driven, it forces the blade unit (in the preferred invention, including a later described blade plate holder and blade plate holder frame) 200 up and down to drive the blade 212. The cam attending opening 204 would likely (as later shown) be wider (parallel to the bottom 206 of the blade unit 200 than represented in FIG. 2.

Figures 3A, 3B, 3C, 3D:
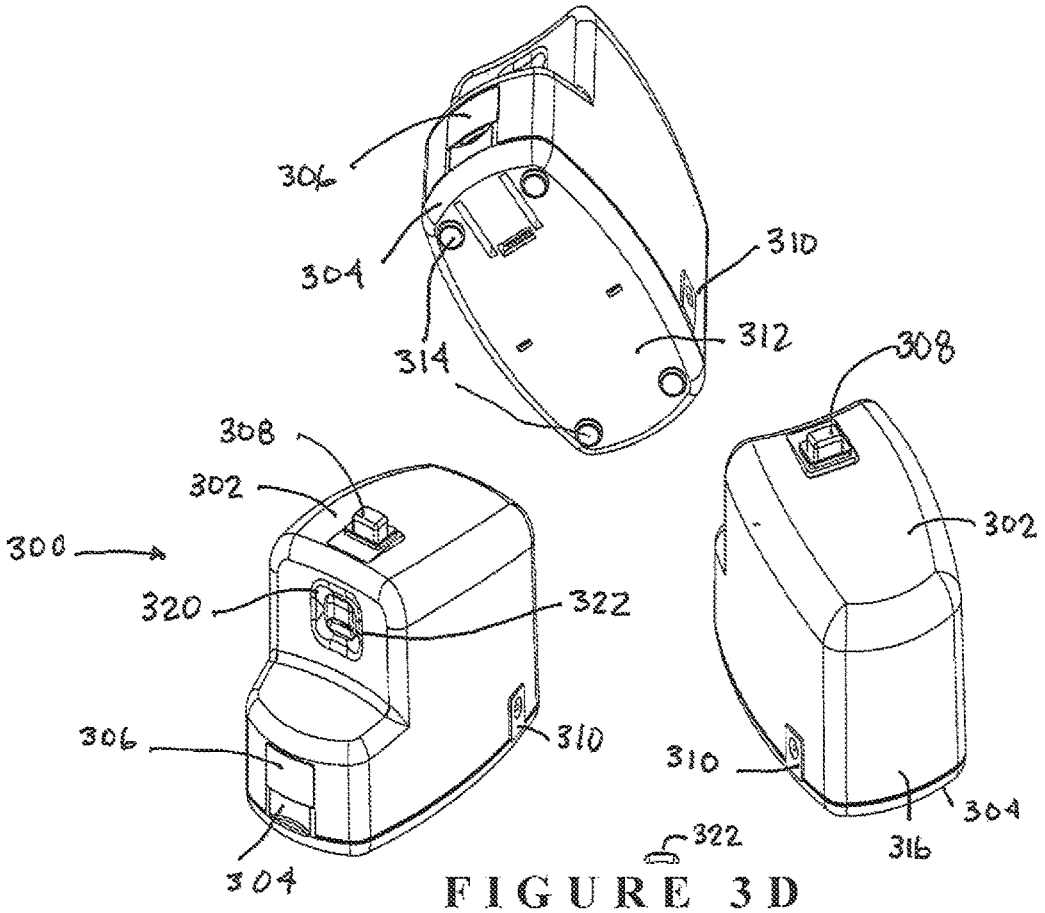
FIG. 3A is a top-side perspective view of an electrically-powered nail cutting apparatus according to the present invention.
FIG. 3B an upward left-side perspective view from the bottom of an electrically-powered nail cutting apparatus according to the present invention.
FIG. 3C is a right-side read end perspective view of an electrically-powered nail cutting apparatus according to the present invention.
FIG. 3D is a front view of a nail slot showing a flat bottom edge and a curved top edge. The top and bottom edges could both be curved or both be flat.

FIG. 3A is a left-side front-right or front-to-rear perspective view of an electrically-powered nail cutting apparatus 300 according to the present invention. The electrically-powered nail cutting apparatus 300 is shown with a top 302, bottom 304, removable nail cuttings tray 306, on-off button 308, external power source connection 310, digit-supporting recessed area 320 and nail-accepting slot 322. Although an external power source is illustrated in this FIG. 3A, an internal battery-source (not shown) may of course be used. Identical numbers in FIGS. 3B and 3C are identical elements in the electrically-powered nail cutting apparatus 300 according to the present invention.

FIG. 3B is a top-side bottom-right or bottom-to-top perspective view of an electrically-powered nail cutting apparatus 300 according to the present invention. A bottom plate 312 and legs 314 are shown. The legs 314 may be pads to prevent the electrically-powered nail cutting apparatus 300 according to the present invention from scratching surfaces on which it is placed.

FIG. 3C is a right-side rear-right or rear-to-front perspective view of an electrically-powered nail cutting apparatus 300 according to the present invention. A back or rear surface 316 is also shown.

FIG. 3D is a front view of a nail-accepting slot 322 showing a flat bottom edge and a curved top edge. The top edge and bottom edge should always be the same relative shape. They could be flat on top and bottom in child or infant versions.

Figure 4:
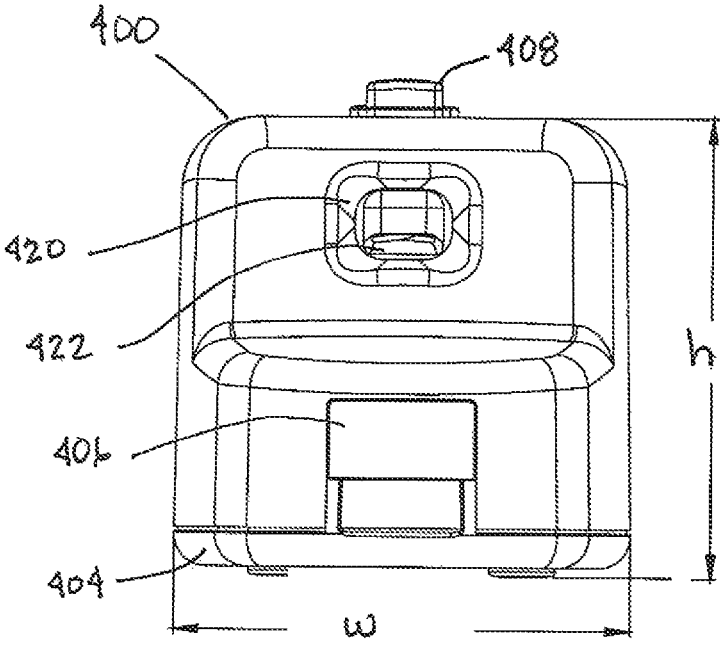
FIG. 4 is a front view of an electrically-powered nail cutting apparatus according to the present invention.

FIG. 4 is a front view of an electrically-powered nail cutting apparatus 400 according to the present invention. The recessed digit receiving area 420 with a nail-accepting slot 422 is shown. The removeable clippings capture tray 406, bottom 404 and on-off button 408 is shown, along with the height h and width w of the device.

Figure 5:
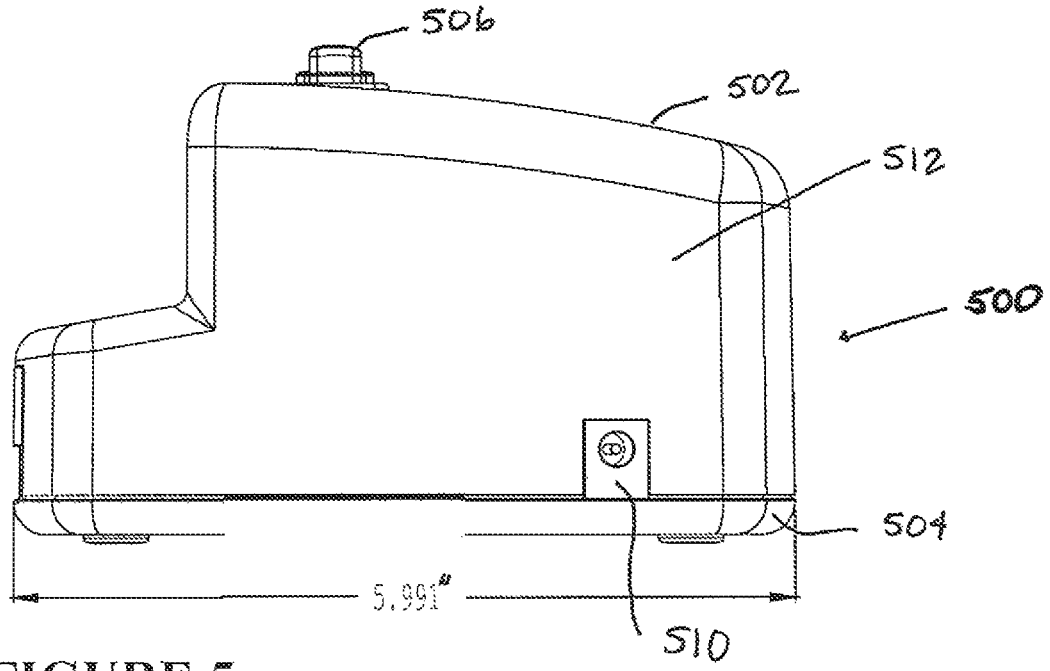
FIG. 5 is a right-side view of an electrically-powered nail cutting apparatus according to the present invention.

FIG. 5 is a left-side view of an electrically-powered nail cutting apparatus 500 according to the present invention. The electrically-powered nail cutting apparatus 500 has a top 502, bottom 504, electric receptor 510, right side wall 512 and on-off button 506.

FIG. 6 is a back-to-front perspective view of an opened electrically-powered nail cutting apparatus 600 according to the present invention. Shown on the opened electrically-powered nail cutting apparatus 600 are an electric motor 602, support box 604 for the on-off button 606, and an external structural frame 608 to support forward elements in the opened electrically-powered nail cutting apparatus 600. The external electric source connection 612 is shown overlaying the bottom or base 614 having a frame 610. FIG. 7 is a front-to-back perspective view of an opened electrically-powered nail cutting apparatus 700 according to the present invention. Again are shown an electric motor 702, support box 704 for the on-off button 706, and an external structural frame 708 and 710 to support forward elements in the opened electrically-powered nail cutting apparatus 700. Among the forward elements are the insertable/removable front access plate, the recessed area for positioning digits 730, a chute 726 for capturing nail clippings (not shown) and directing them for deposit into removable clipping tray 722 with a capture area 724 for the nail clippings. A support frame 720 for guiding the removable tray 722 is shown. The motor may contain a timing function (not shown) such as a circuit, rheostat or microchip to control the speed, time repetition sequence, time intervals and the like for operation of the motor so that the blades moves up and down at an effective rate (e.g., a complete cycle at least every minute and preferably within 3-50 seconds or every 5-50 seconds). The circuit may be a field programmable gated array (FPGA) or ASIC (application specific integrated circuit), the first being programmable, and the second being hardened in the integrated circuit. An external power receptacle 712 is shown.

Figure 8A:
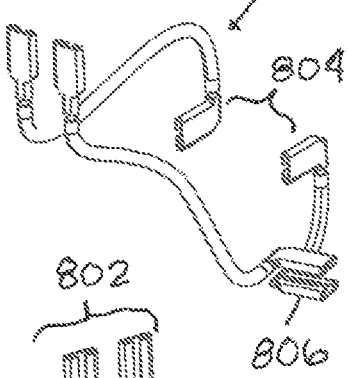
FIG. 8A is a front-to-rear back perspective view of electrical clips to attach a power source to a motor driving movement of the blade in an electrically-powered nail cutting apparatus according to the present invention.

FIG. 8A is a front-to-back perspective view of electrical clips 800 to attach a power source to a motor driving movement of the blade in an electrically-powered nail cutting apparatus according to the present invention. The two sets of clips, one clipped to the on-off controls 802 and the other connected to the motor 804 are shown. Clips 806 go to the external electrical power source connection 712 in FIG. 7) may be a ground or stabilizing clip to prevent excess internal movement of the clips 800. Identical numbers in FIG. 8A are identical elements described in FIG. 8A.

Figure 8B:
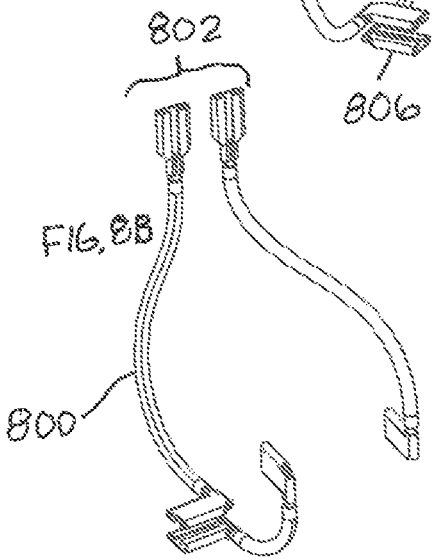
FIG. 8B is aback rear-to-front perspective view of electrical clips to attach a power source to a motor driving movement of the blade in an electrically-powered nail cutting apparatus according to the present invention.

FIG. 8B is a back-to-front perspective view of electrical clips 800 to attach a power source to a motor driving movement of the blade in an electrically-powered nail cutting apparatus according to the present invention.

FIG. 9A is a front-to-back perspective view of electrical motor 900 used to assist in motivating cutting blade movement. The motor 900 is shown with an electric plug 906, rotating shaft 902 and eccentrically positioned cam post 904. As the motor 900 rotates the shaft 902. Looking at the movement of the eccentric cam post 904 and the oblong oval cam-receiving opening in the blade plate holder frame (not shown) attending opening 204 (in FIG. 2) to assist in movement of the blade unit 200, as shown in FIG. 2, as the cam post 904 is rotated up, the blade plate unit 200 is elevated to a highest position. As the cam post 904 rotates down, it presses against the lowest interior edge of the oblong oval cam-receiving opening 1228 cam attending opening 204 to force movement of the blade plate unit 200 in a downward path. The downward force will press the blade plate 200 against and through any nail extending into the device. The motor 900 speed and torque applied to the cam post 904 will determine the frequency of cutting operations and the force applied during those cutting operations. The motor may be programmed to move continuously (same rotation frequency and speed for the shaft 902, or may have its speed in a step manner, such as to move the blade plate unit 200 down at an optimal speed, stop at a lowest position of the blade plate unit 200, lift the blade unit at a desired speed (less significant because the speed is merely to reset the blade plate unit 200 to a pre-cutting position (as with an elevated guillotine blade), and then optionally pause (a light may be used to indicate that a pause position has been reached), and the shaft 902 rotated to force the blade plate unit 200 down to cut any nail that has been inserted into the device. FIG. 9B is a back-to-front perspective view of electrical motor 900 used to assist in motivating cutting blade movement. Electrical plugs 906 and the forward positioned shaft 902 are also shown.

Figures 10A, 10B, 10C:
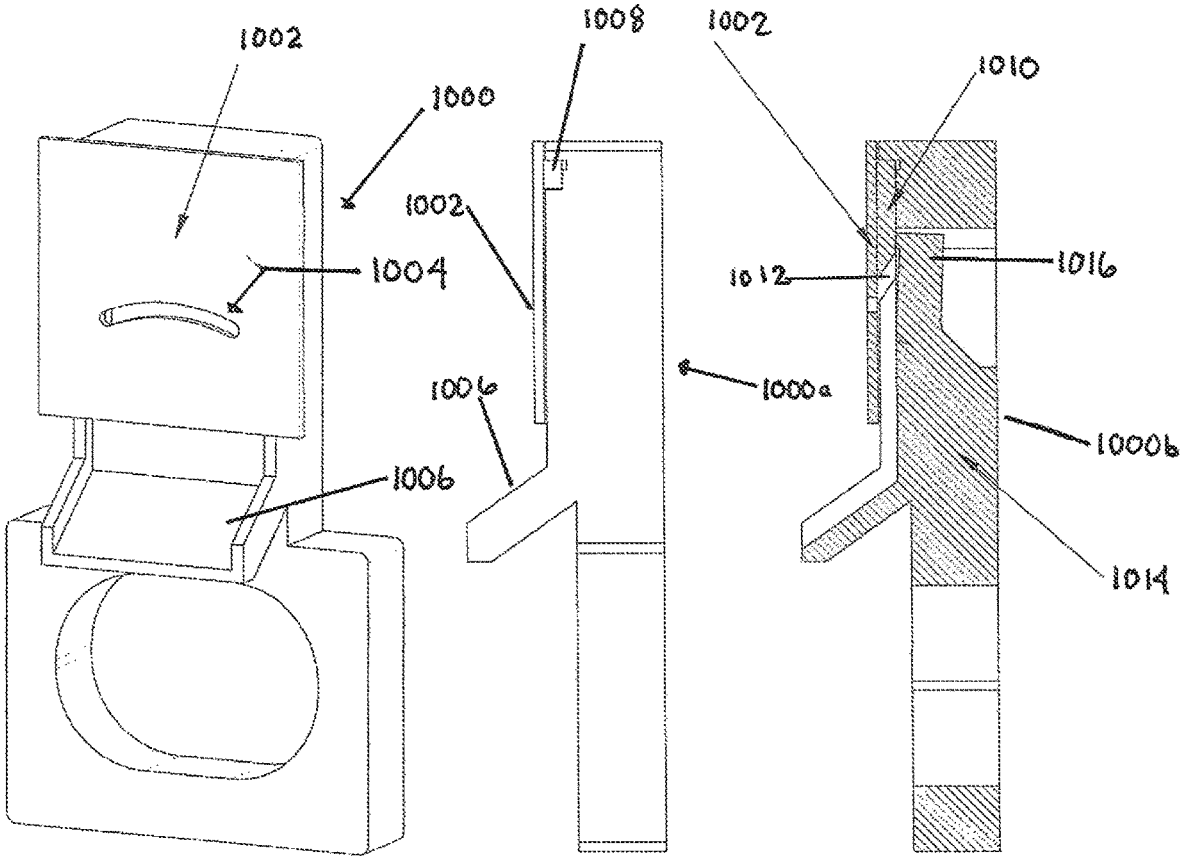
FIG. 10A shows a perspective view of a front section of the electrically-powered nail clipping system of the present invention.
FIG. 10B shows a side cutaway view of the front section of the electrically-powered nail clipping system of the present invention shown in FIG. 10A, but without the blade shown.
FIG. 10C shows a side cutaway view of the front section of the electrically-powered nail clipping system of the present invention shown in FIGS. 10A and 10B, but with the blade shown supported by a spring feature and the front access plate in position and glide controls.

FIG. 10A shows a perspective view of the blade plate holder frame a front section of the electrically-powered nail clipping system 1000 of the present invention. The front plate 1002 is shown with the nail accessing curved opening 1004, the chute 1006 for directing nail clippings, FIG. 10B shows a side cutaway view of the blade plate holder frame front section of the electrically-powered nail clipping system of the present invention 1000*a* shown in FIG. 10A, but without the blade shown. The forward blade support elements or glide controls 1008 are glide supports on both sides of a blade (not shown). The front plate 1002 and the chute 1006 are also shown.

FIG. 10C shows a side cutaway view of the blade plate holder frame front section of the electrically-powered nail clipping system of the present invention 1000*b* shown in FIGS. 10A and 10B, but with the blade (or blade plate) 1012 shown supported by the blade holder frame is a spring 1014 1000*b* and blade guide support features glide controls 1008 1010. The top portion of the blade plate holder frame 1000*b* acts as a spring portion 1016 of the spring 1014 to maintain pressure on the blade 1012 so that the blade 1012 remains flush against the inside of the front access plate 1002 (which acts as a bracing plate 1002 against the side of the blade plate) as the blade plate 1012 slides up and down. As previously stated, and here further shown in FIG. 10C, the blade plate 1010 carrying a blade 1012 is free sliding, and can be removed. slid upward out of the apparatus (e.g., for replacement or sharpening). or it may be manually or tool-removed from the groove 1011.

FIG. 10C shows a side cutaway view of the front section of the electrically-powered nail clipping system 1000 of the present invention shown in FIG. 10A, but with the blade 1010 shown. The cover 1002 is on the front of the clipping system 1000. The bottom cutting edge 1012 of the blade 1010 is shown supported between the cover 1002 and a spring/tension-providing plate 1014, with a top, forward pressing component 1016 keeping the blade 1010 stable without wobbling as it is driven during a cutting operation.

Figure 11B:
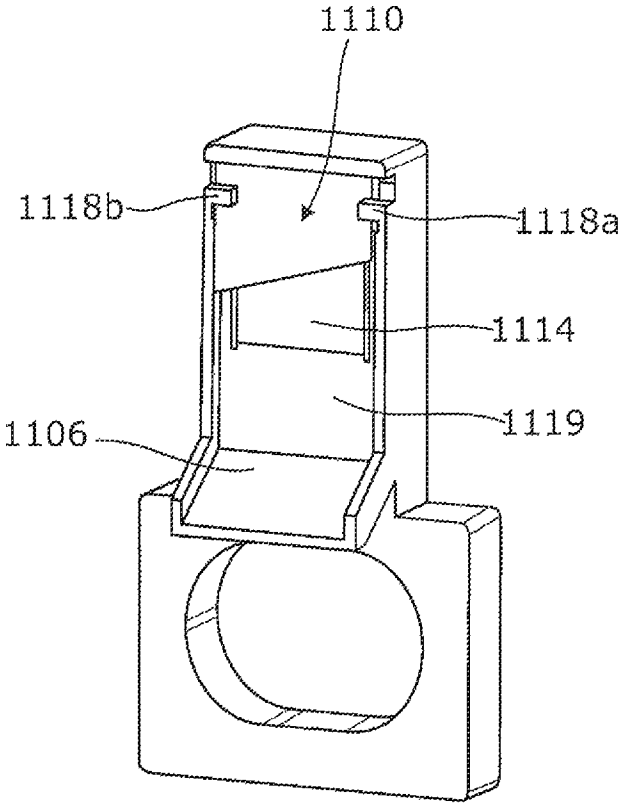
FIG. 11B shows a perspective view of a front section of the electrically-powered nail clipping system of the present invention with the front access cover plate removed to expose the blade supported by interior supports.
Figure 11A:
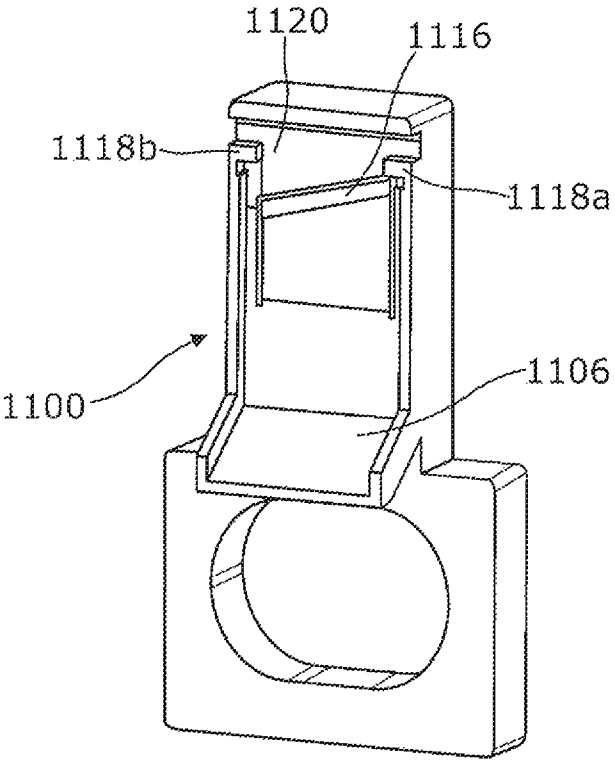
FIG. 11A shows a perspective view of a front section of the electrically-powered nail clipping system of the present invention with the cover front access plate removed to expose the interior supports for the blade.

FIG. 11A shows a perspective view of a front section of the electrically-powered nail clipping system 1100 of the present invention with the cover front access plate removed to expose the interior supports 1118*a* and 1118*b* for the blade (not present). There is spacing or groove 1120 behind each of the interior supports 1118*a* and 1118*b* and in front of the pressure ridge forward section 1116 of the spring/tension-providing feature of the blade plate holder frame plate 1014 (of FIG. 10C 10B).

FIG. 11B shows a perspective view of a front section of the electrically-powered nail clipping system with a blade plate 1110 of the present invention with the front access cover plate removed to expose the blade plate 1110 supported by interior supports of the blade plate holder frame interior supports or glide controls 1118*a* and 1118*b* on the sides forming grooves behind the front face of the housing (not shown) to control a blade plate 1110 carrying a blade 1012 (from FIG. 10C) and in front of the pressure ridge 1116 (of FIG. 11A) and spring/tension-providing feature plate 1114 above a back plate 1119 above the chute 1106. There is also a bracing plate 1122 located against a side of the blade plate 1110 carrying a blade 1012 between the spring tension providing plate 1114 and the glide controls 1118*a* and 1118*b*. This is also shown in FIG. 10C, with elements (the cover) 1002, (the blade plate) 1010 and (forward pressing component) 1016. The combined tension between the interior supports 1118*a* and 1118*b*, the pressure ridge 1116 and in front of the spring/tension-providing feature plate 1114 established part of a biasing, guiding track 1120*a* 1120*b* for the blade plate 1110 carrying carries a blade 1012 to travel along and not be deflected out of alignment as the cutting edge of the blade plate 1110 slices through a nail.

Figure 12B:
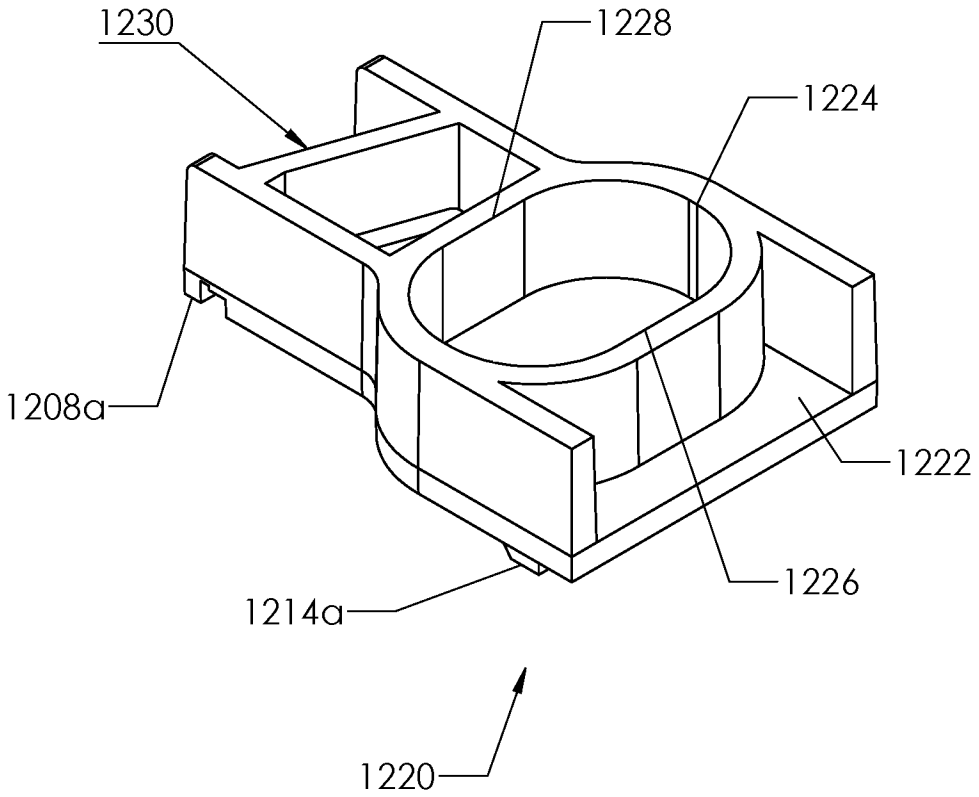
FIG. 12B shows a perspective view of the back side of the blade plate holder frame with the oblong, oval cam-receiving opening.

FIG. 12B shows a perspective view of the back side of the blade plate holder frame 1220 with the top of oblong, oval cam-receiving opening 1228 shown. The pins or posts 1208*a* are shown, where the blade plate (not shown) is engaged with and secured to the blade plate holder frame 1220. A side of the oblong, oval cam-receiving opening 1224 and a top ridge of the bottom of the oblong, oval cam-receiving opening 1226 are also shown. A top portion of the clipping capturing sloped plate 1214*a* is shown. Structural face 1222 and structural rib 1230 on the blade plate holder frame 1220 are also shown. As a cam extending presses into the face of the top of oblong, oval cam-receiving opening 1228, the entire blade plate holder frame 1220 (carrying the secured blade, which is not shown) is lifted into a pre-clipping position. As a cam extending presses into the face of the bottom of oblong, oval cam-receiving opening 1226, the entire blade plate holder frame 1220 (carrying the secured blade, which is not shown) is lifted into a post-clipping position.

Figure 12C:
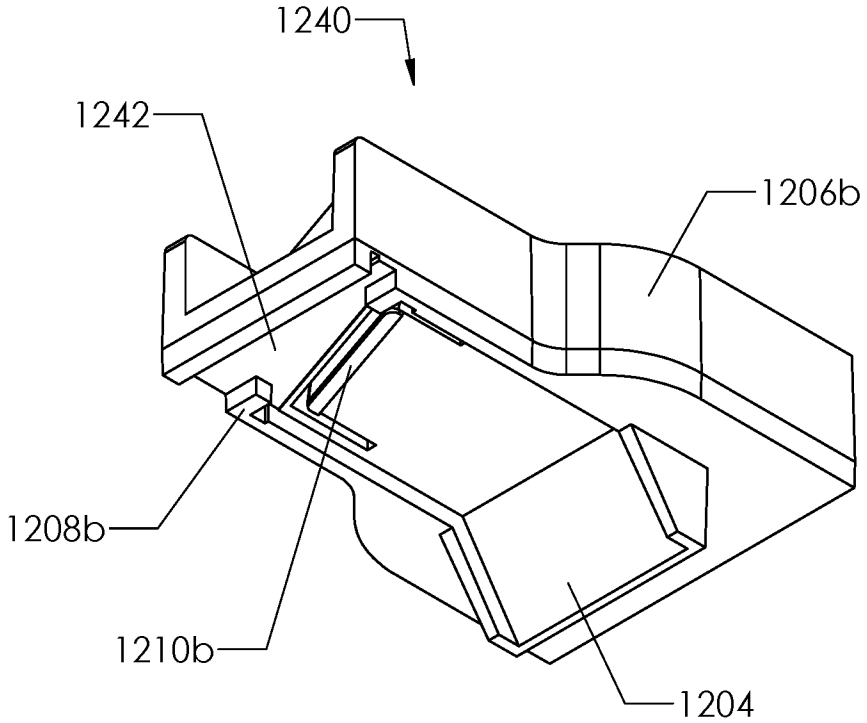
FIG. 12C shows a perspective view of the front side of the blade plate holder frame with the raised pressure ridges shown in an area where the blade plate is set.

FIG. 12C shows a perspective view of the front side of the blade plate holder frame 1240 with the raised pressure ridges 1210*b* shown in an area 1242 where the blade plate is set and supported by the pins or posts or arms 1208*b*. A clipping capturing sloped plate 1204 is shown. This clipping capturing sloped plate 1204 may just direct clipping away from the blade plate holder frame 1240 or may direct them into a tray (not shown).

Figure 13A:
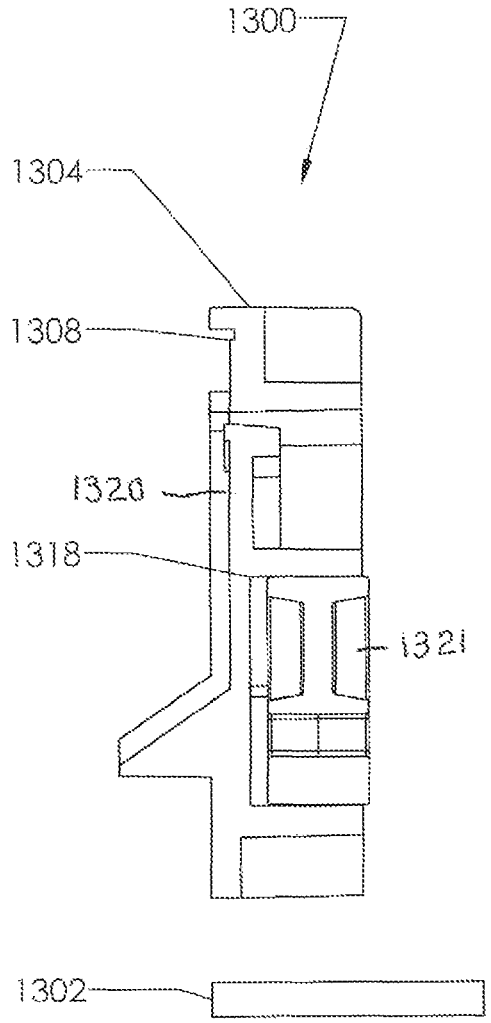
FIG. 13A shows a side. cutaway view of the blade plate holder frame with blade plate receiving area and edges of the oblong, oval cam-receiving opening, the blade plate holder frame in an elevated position over the bottom of the housing.

FIG. 13A shows a side. cutaway view of the blade plate holder frame 1300 with blade plate receiving area 1308 and edges of the oblong, oval cam-receiving opening 1318, the blade plate holder frame in an elevated position over the inside, bottom of the housing 1302. The top of the blade plate holder frame 1304 may or may not contact the top inner surface of the housing (not shown). An upper back, support plate 1320 and a lower back support plate 1318 that provides pressure (through the ridges of FIG. 12C) against the blade plate (not shown) is part of the blade plate holder frame 1300.

Figure 13B:
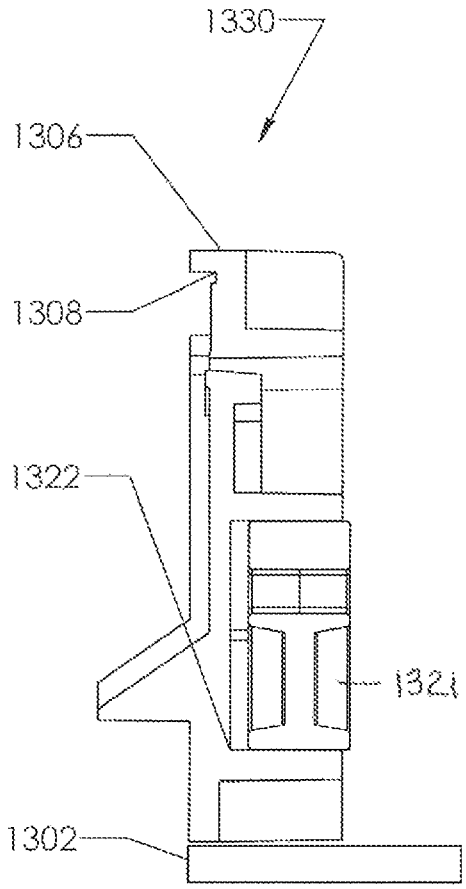
FIG. 13B shows a side. cutaway view of the blade plate holder frame with blade plate receiving area and edges of the oblong, oval cam-receiving opening, the blade plate holder frame in a lowermost position over or in contact with the bottom of the housing.

FIG. 13B shows a side. cutaway view of the blade plate holder frame 1330 with blade plate receiving area 1308 and edges of the oblong, a lower back support plate 1322 that provides pressure (through the ridges of FIG. 12C) against the blade plate (not shown) oval cam-receiving opening 1321, the blade plate holder frame 1330 in a lowermost position over or in contact with the bottom of the housing 1302. The top of the blade plate holder frame 1306 may or may not contact the top inner surface of the housing (not shown). This is mainly for further enablement of how the device may be built from component parts are constructed from those component parts.

Figure 14:
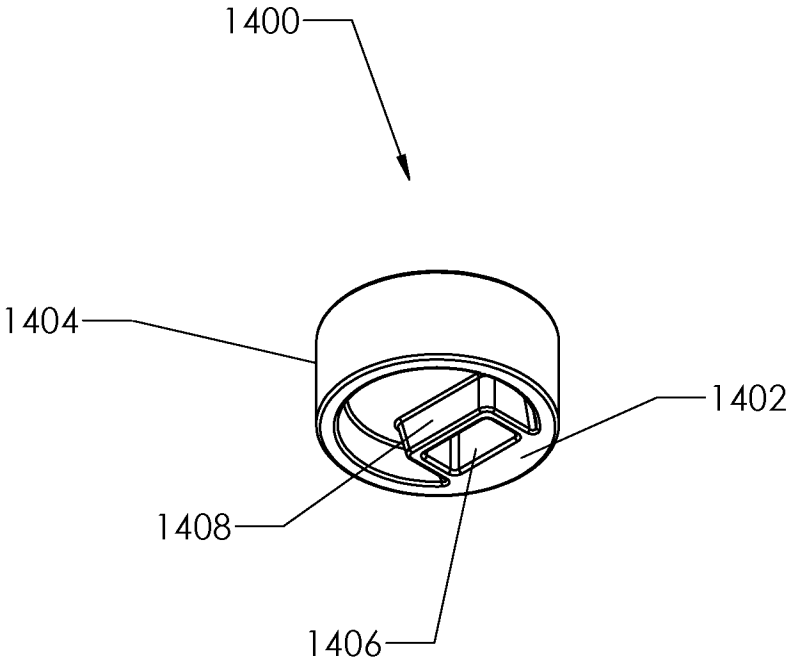
FIG. 14 shows the cam element with the extending cam positioned off-center within the cam receiving opening so that rotation of the entire cam element causes the distal edge of the cam to move in a relatively circular manner within the cam receiving opening.

FIG. 14 shows the cam element 1400 with the motor shaft receiving element 1408 bound continuously within the cam by solid structure 1402 with the shaft receiving opening 1406 positioned off-center within the cam element 1400 so that rotation of the entire cam element 1400 causes the outermost edge 1404 cam 1404 to move in a relatively circular manner within the cam-receiving opening (not shown) on the rear side of the blade plate holder frame (not shown). The rotating cam 1400 is elevated above a forward base plate 1402 so as to engage with the cam-receiving opening (1228 in FIG. 12B) and move the entire blade plate holder frame (not shown) up and down consecutively, thus moving the held or restrained blade (not shown) up and down, to clip nails inserted into the clipping area. The distal outside surface 1404 of the cam 1400 presses up against the cam-receiving opening to raise the blade plate holder frame, and then presses downwardly within the blade plate holder frame to lower the entire blade plate holder frame in a clipping action.

The shaft from the motor (not shown) is inserted into opening 1406, so that when the shaft rotates the cam 1400, the top outside surface 1404 impacts the oblong opening on the back side of the blade plate holder frame.

Figure 15:
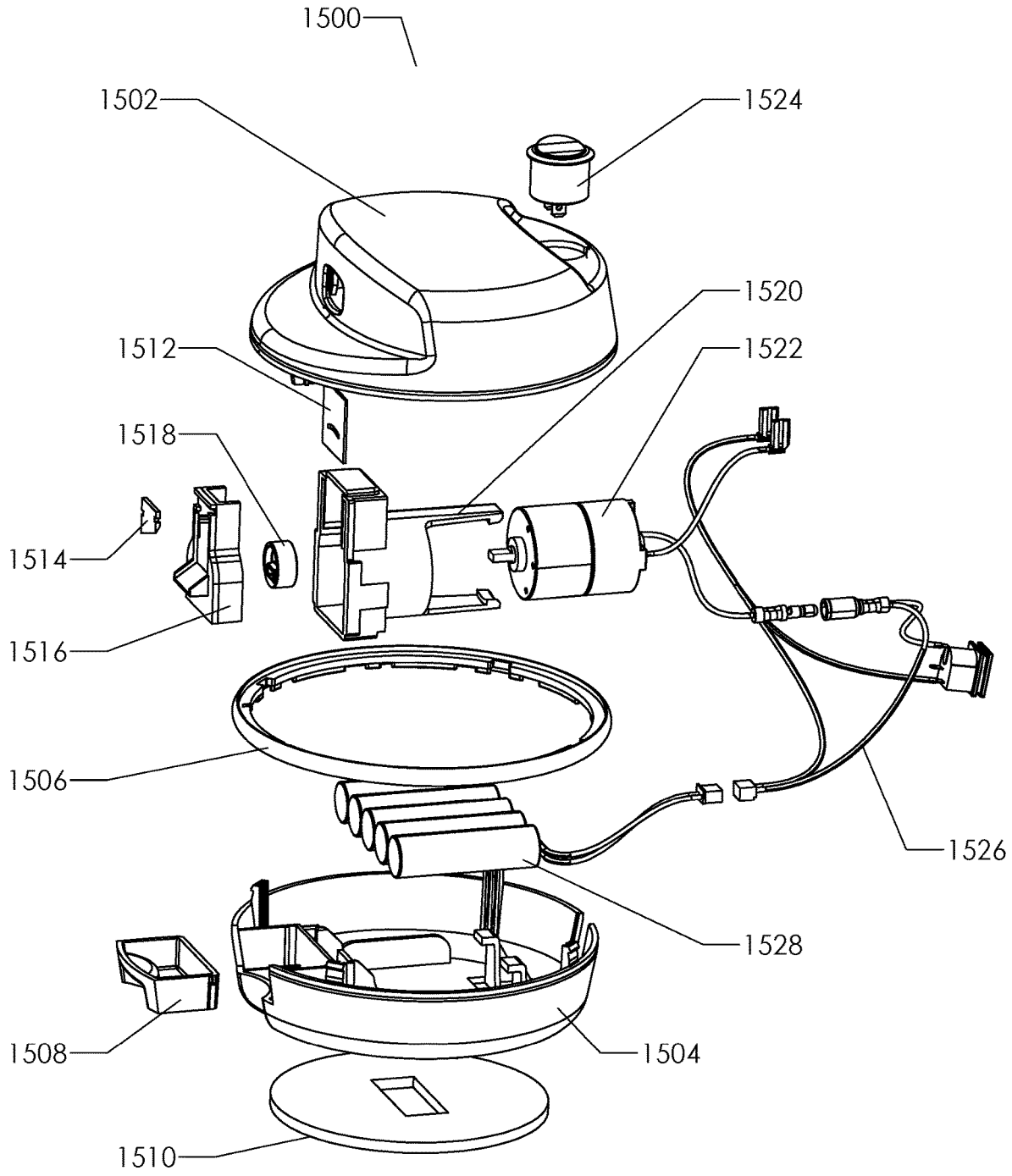
FIG. 15 is an exploded view of one embodiment of an electronic nail clipping device within the scope of the present invention.

FIG. 15 is an exploded view of one embodiment of an electronic nail clipping device 1500 within the scope of the present invention. The device 1500 is shown with an on-off button 1524 on a top section 1502 for the system. A front plate with nail opening 1512 fits into the support 1520 for the blade plate holder 1516 which has the blade plate 1514 to be attached to the blade plate holder 1516. The cam element 1518 is shown, which will be connected through its back side to the electric motor with shaft 1522.

An electrical connection system 1526 connects the electric motor with shaft 1522 to an internal battery power source 1528. A connecting ring 1506 engages both the top section 1502 and the bottom section 504 to secure the various elements to and within the nail clipping device 1500.

A nail-clippings capture tray 1508 engages in the bottom section 1504 which in turn is seated on a footing 1510 that closes an opening in the base of the bottom section 1504.

The shaft on the electric motor 1522 passes through the support 1522 for the blade plate holder frame 1522 to engage the cam elements 1518 which engages with the blade plate holder 1516. The entire blade plate holder 1516 is thus driven upward and downward within the device 1500.

Although specific materials, dimensions and descriptions are provided, these examples are mere species within the generic concepts of the present invention.

What is claimed:

1. An automatic nail clipping device comprising:

a covering shell;

a blade plate having a blade, an opposed edge, a front face and a rear face, and joining the blade and opposed edge, two side edges;

each side edge having a) a notch or hole therein or b) a pin or post therein;

each blade plate supported in a blade holder frame supporting the two side edges and the rear face;

the blade holder frame having c) two posts fitted into the notches or holes in the side edge or d) two holes or notches fitted onto the pin or post;

the blade holder frame having a front face with a raised pressure ridge thereon providing pressure against the blade plate transferring said pressure through the blade plate to the rear of a face plate, and a rear face with an oval cam receiving opening therein;

the blade holder frame slideably engaged within a motor mount frame;

the face plate, stably fixed to the covering shell motor frame mount, with a slot in the face plate for allowing nails of a human being to pass through the slot to a cutting area within the covering shell;

engaging the cam receiving opening in the rear face of the blade holder frame is an eccentrically revolving cam;

an electric motor connected to the cam through a rotatable shaft;

the motor configured to rotate the rotatable shaft, revolving the eccentrically revolving cam;

the eccentrically revolving cam configured to apply varying force against the oval cam receiving opening in the rear face of the blade holder frame, thereby causing the entire blade holder frame to slide up and down within the motor mount frame, moving the blade plate parallel against a plane of the face plate.

2. The device of claim 1 wherein then blade holder frame further comprises an outwardly-sloped plane to catch and redirect nail clippings from behind the face plate to a front area of the face plate and each side edge having a) the notch or hole therein.

3. The device of claim 1 wherein an on-off switch is present on the covering shell to close a circuit allowing power to flow to the electric motor and each side edge having a) the notch or hole therein.

4. The device of claim 3 wherein the covering shell comprises a first top piece and a second bottom piece, and connection of the first top piece and the second bottom piece fixes the motor frame mount within the covering shell and provides space for the blade holder frame to slide unobstructed along a complete upward track and a complete downward track.

5. The device of claim 4 wherein the blade holder frame further comprises an outwardly-sloped plane to catch and redirect nail clippings from behind the face plate to a front area of the face plate.

6. The device of claim 5 wherein the second bottom piece has an indentation in front of and below the face plate, and a sliding tray inserted into the indentation to capture nail clippings from the outwardly sloped plane.

7. The device of claim 4 wherein the covering shell encloses a battery pack for carrying at least one battery that can power the electric motor.

8. The device of claim 4 wherein a timer is engaged with the electric motor to cause timed intervals between movement of the blade holder frame by the motor.

9. The device of claim 4 wherein movement of the blade is effected by the rotations per minute of a drive shaft driven by the electric motor.

10. The device of claim 4 wherein the raised pressure ridge provides pressure against the blade plate which biases the blade plate against the face plate as the blade holder frame reciprocates up and down.

11. The device of claim 1 wherein the cam is circular, with a motor shaft receiving opening that is off-center within the circular cam.

12. A method of cutting nails of fingers or toes of a human on an automatic nail clipping device comprising:

a covering shell;

a blade plate having a blade, an opposed edge, a front face and a rear face, and joining the blade and opposed edge, two side edges;

each side edge having a notch or hole therein;

each blade plate supported in a blade holder frame supporting the two side edges and the rear face;

the blade holder frame having two posts fitted into the notches or holes in the side edge;

the blade holder frame having a front face with a raised pressure ridge thereon providing pressure against the blade plate transferring said pressure to the rear of a face plate through the blade to the front face, and a rear face with an oval cam receiving opening therein;

the blade holder frame slidably engaged within a motor mount frame;

the face plate, stably fixed to the motor mount shell with a slot in the face plate for allowing nails of a human being to pass through the slot to a cutting area within the covering shell;

engaging the cam receiving opening in the rear face of the blade holder frame is an eccentrically revolving cam;

an electric motor connected to the cam through a rotatable shaft;

the motor configured to rotate the rotatable shaft, revolving the eccentrically revolving cam;

the eccentrically revolving cam configured to apply varying force against the oval cam receiving opening in the rear face of the blade holder frame, thereby causing the entire blade holder frame to slide up and down within the motor mount frame, moving the blade plate parallel against a plane of the face plate, wherein the method comprises powering the electric motor to motivate the blade plate holder up and down, inserting a nail through the slot, and clipping the nail, the nail clipping dropping into a receptor.

13. The method of claim 12 wherein the covering shell comprises a first top piece and a second bottom piece, and connection of the first top piece and the second bottom piece fixes the motor frame mount within the covering shell and provides space for the blade holder frame to slide unobstructed along a complete upward track and a complete downward track.

14. The method of claim 13 wherein the blade holder frame further comprises an outwardly-sloped plane, the plane catching and redirecting nail clippings from behind the face plate to an area in front of the face plate.

15. The method of claim 12 wherein a timer engages with the electric motor to cause timed intervals between movement of the blade holder frame by the motor.

16. The method of claim 12 wherein repeated motion of the movement of the blade is effected by rotations per minute of a shaft from the electric motor driving the cam and moving the blade plate holder frame in a repetitive motion.

17. A method of cutting nails of fingers or toes of a human on an automatic nail clipping device comprising:

a covering shell;

a blade plate having a blade, an opposed non-sharpened edge, a front face and a rear face, and joining the blade and opposed edge, two side edges;

each side edge having a) a notch or hole therein or b) a pin or post therein;

each blade plate supported in a blade holder frame supporting the two side edges and the rear face;

the blade holder frame having c) two posts fitted into the notches or holes in the side edge or d) two holes or notches fitted onto the pin or post;

the blade holder frame having a front face with a raised pressure ridge thereon providing pressure against the blade plate transferring said pressure to the rear of the face plate through the blade to the front face, and a rear face with an oval cam receiving opening therein;

the blade holder frame slidably engaged within a motor mount frame;

a face plate, stably fixed to the motor mount shell with a slot in the face plate for allowing nails of a human being to pass through the slot to a cutting area within the covering shell;

engaging the cam receiving opening in the rear face of the blade holder frame is an eccentrically revolving cam;

an electric motor connected to the cam through a rotatable shaft;

the motor configured to rotate the rotatable shaft, revolving the eccentrically revolving cam;

the eccentrically revolving cam configured to apply varying force against the oval cam receiving opening in the rear face of the blade holder frame, thereby causing the entire blade holder frame to slide up and down within the motor mount frame, moving the blade plate parallel against a plane of the face plate, wherein the method comprises powering the electric motor to motivate the blade plate holder up and down, inserting a nail through the slot, and clipping the nail, the nail clipping dropping into a receptor.

18. The method of claim 17 wherein the cam is circular, with a motor shaft receiving opening that is off-center within the circular cam.

19. An electrically-powered nail cutting apparatus (300) comprising a housing, an open slot, a vertical translating nail-cutting blade plate, a motor (900) comprising a rotating shaft (902) and an eccentric cam post (904):

a) said housing having a front face (102,1002) and a rear face (316), two sides, a top (302) and a bottom (304, 404);

b) the front face (100) of the housing having said open slot (108,322,422) at least 0.5 mm in height and between 0.7 cm and 3 cm in width, the slot having a front-facing opening and a rear-facing opening;

c) within the housing and proximal to the rear-facing opening is said vertically translating nail-cutting blade plate (200,1000,1100) associated with said electric motor (602,702,900) that is configured to translate the nail-cutting blade plate consecutively down and up through the rotational action of an electrical motor having a rotating shaft having an eccentrically positioned cam post (904); and d) the eccentrically positioned cam post engaging the blade plate in a slot in the blade plate, the blade plate (200,1000,1100) comprising a solid material having an opening therein, wherein the blade plate carries a cutting blade (212,1012,1110) with a cutting edge such that the cutting edge is adjacent the rear-facing opening;

e) wherein the cam has a post engaging a slot in the blade plate relatively below the opening to the blade, so that the blade plate is pulled down and pushed up by the rotating movement of the post extending from the cam, driven by the motor;

f) the cutting blade plate (200) has a structural frame (202), a blade providing opening (210), a cam attending opening (204) to assist in movement of the blade unit (200), a bottom surface (205) of the blade unit (200), and a blade (212) which is moved repeatedly up and down to slice nails inserted into the electrically-powered nail cutting apparatus, wherein said rotating shaft (902) with said eccentrically positioned cam post (904) has the post positioned within the cam attending opening (204) and as the cam post is eccentrically driven, it forces the cutting blade plate (200) up and down to drive the blade (212); and g) as the cam post (904) is rotated up, the blade unit (200) is elevated to a highest position and as the cam post (904) rotates down, it presses against the lowest interior edge of the cam attending opening (204) to force movement of the cutting blade plate (200) in a downward path, wherein the downward force will press the blade (212) against and through any nail extending into the device.

* * * * *